US006562228B2

(12) United States Patent
Yamada

(10) Patent No.: US 6,562,228 B2
(45) Date of Patent: May 13, 2003

(54) ULTRASONIC PICKLING METHOD AND PICKLING DEVICE

(75) Inventor: Yoshihiro Yamada, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/937,209

(22) PCT Filed: Mar. 8, 2001

(86) PCT No.: PCT/JP01/01834

§ 371 (c)(1),
(2), (4) Date: Sep. 24, 2001

(87) PCT Pub. No.: WO01/66829

PCT Pub. Date: Sep. 13, 2001

(65) Prior Publication Data

US 2002/0153264 A1 Oct. 24, 2002

(30) Foreign Application Priority Data

Mar. 8, 2000 (JP) ..... 2000-063674

(51) Int. Cl.[7] ..... C23G 3/00

(52) U.S. Cl. ..... 205/704; 205/724; 205/736; 204/196.01

(58) Field of Search ..... 205/704, 724, 205/736; 204/196.01

(56) References Cited

U.S. PATENT DOCUMENTS 4,167,424 A * 9/1979 Jubenville et al. ..... 134/1

FOREIGN PATENT DOCUMENTS

| | | |
|---|---|---|
| JP | 62-210082 | 9/1987 |
| JP | 3-110607 | 2/1991 |
| JP | 03-247785 | 5/1991 |
| JP | 3-103256 | 10/1991 |
| JP | 10-1800 | 1/1998 |

OTHER PUBLICATIONS

B.J. Goode et al.: *Kinetics of pickling of low carbon steel*; Ironmaking and Steelmaking 1996, vol. 23, No. 2, pp. 164–170 no month.

B.J. Goode et al.: *Use of ultrasound in strip steel pickling process*; Ironmaking and Steelmaking, 1997, vol. 24, No. 1, pp. 72–78 no month.

* cited by examiner

*Primary Examiner*—Arun S. Phasge
(74) *Attorney, Agent, or Firm*—Kenyon & Kenyon

(57) ABSTRACT

The present invention pertains to: a method of ultrasonic pickling by impressing a protective potential of not less than −300 mV baser than the corrosion potential of an ultrasonic diaphragm installed in a pickling solution on the ultrasonic wave imposing means and carrying out pickling while supplying corrosion preventive current of not less than 100 mA/m$^2$ to a corrosion preventive current imposing means whose negative electric terminal is connected to the ultrasonic wave imposing means and whose positive electric terminal is connected to the pickling solution or a travelling strip material; and an apparatus for ultrasonic pickling, as an apparatus to embody the method.

4 Claims, 4 Drawing Sheets

ULTRASONIC PICKLING METHOD AND PICKLING DEVICE

TECHNICAL FIELD

The present invention relates to a method of ultrasonic pickling and a pickling apparatus for steel strips and steel sheets or nonferrous metal sheets and the like, and aims particularly at improving the acid resisting properties of ultrasonic diaphragms to be installed in an acid solution of hydrochloric acid, sulfuric acid or the like.

BACKGROUND ART

So far, pickling treatment by hydrochloric acid or sulfuric acid has been applied to removing oxided scale adhering to steel sheet surfaces or cleaning the surfaces in a production process of steel strips and steel sheets in the production field of iron and steel. AS for this pickling method, there are a method of removing scale by simply dipping steel sheets or steel strips in an acid solution and another method of removing scale by further installing ultrasonic diaphragms in the acid solution and taking advantage of the ultrasonic vibrations. Various technologies for installing ultrasonic diaphragms in an acid solution have been proposed. For example, in Japanese Unexamined Patent Publication No. S62-210082, disclosed is a technology aiming at improving acid resisting properties and wear resistance by making diaphragms composed of ultrasonic vibrators with a metallic material containing a specific proportion or more of Ta and/or Nb. Further, in Japanese Unexamined Patent Publication No. H4-187749, disclosed is a technology aiming at improving corrosion resistance and cavitation erosion resistance in an acid solution by adding Pd in a Ti—Al-V system alloy having a reduced amount of Fe, hot rolling it, and then applying solution heat treatment and aging treatment to it under specific conditions. Furthermore, disclosed are: in Japanese Unexamined Utility Model Publication No. H3-103256, a two-tank type ultrasonic diaphragm unit wherein an ultrasonic diaphragm containing a vibrator itself is mounted in a sealed protective casing composed of acid-resistant resin, water supply and drainage pipes are connected to the protective casing, and water is filled therein; and, in Japanese Unexamined Utility Model Publication No. H3-11060, a pickling apparatus wherein a pickling tank consists of a dual structure having an outer tank and an inner tank, an acid solution is filled in the inner tank and a liquid other than the acid solution is filled between the inner tank and the outer tank, and a plurality of ultrasonic vibrators are attached to the side walls of the outer tank. Further yet, in Japanese Unexamined Patent Publication No. H10-1800, proposed is a scale removing method and an apparatus combining a known electrolytic pickling method with an ultrasonic cleaning method for steel strip surfaces in one compound scale removing operation to remove scale on the surfaces of hot-rolled or cold-rolled steel strips.

As shown in FIG. 4, in a conventional pickling apparatus for a hot-rolled steel strip, scale dissolving treatment has been applied to the surfaces of a hot-rolled steel strip 3 by passing the hot-rolled steel strip through a pickling tank 1 filled with an acid solution 2 and continuously dipping the strip therein. In recent years, being developed are technologies of applying ultrasonic waves to the surfaces of a hot-rolled steel strip 3 via an acid solution 2 by installing ultrasonic diaphragms 4 in a pickling tank 1 to improve scale removing efficiency for the purpose of enhancing productivity. However, presently none of such technologies has been commercially realized, since the diaphragms 4 deteriorate due to the acid and their life is shortened. To overcome this problem, being extensively developed are technologies for prolonging the life of diaphragms 4 by giving acid resisting properties thereto. For example, proposed are: a method of making diaphragms 4 using an acid resistant metal in the pickling apparatus shown in FIG. 4; a method of installing an ultrasonic diaphragm 4 in a sealed protective casing 12 composed of acid-resistant resin and filling the protective casing 12 with water 13 in the pickling apparatus shown in FIG. 5; and a method of passing a hot-rolled steel strip 3 through the interior of a dual casing 12 filled with an acid solution, filling the exterior of the protective casing 12 with water 13, and then installing ultrasonic diaphragms 4 outside a pickling tank 1 in a pickling apparatus shown in FIG. 6.

However, there are following problems in these methods: in the case of Japanese Unexamined Patent Publication No. S62-210082, the equipment cost becomes very high and, moreover, the effect of accelerating pickling can not be obtained; in the case of Japanese Unexamined Patent Publication No. H4-187749, the effect of accelerating pickling can not be obtained either, the cost of the ultrasonic diaphragm becomes high, since a metal having corrosion resistance to high temperature acid is used, and the ultrasonic waves are attenuated, since a sealed casing is used; and in case of the scale removing apparatus disclosed in Japanese Unexamined Patent Publication No. H10-1800, the life of the ultrasonic diaphragm is short and the cost becomes high.

DISCLOSURE OF THE INVENTION

The object of the present invention is, in view of the aforementioned problems, to provide a low cost ultrasonic diaphragm having acid resistance and capable of securing the intensity of ultrasonic waves in ultrasonic pickling used for removing scale on hot-rolled steel sheets. As a result of an extensive study to achieve the object, the present inventors found that it was possible to provide a low cost ultrasonic diaphragm having acid resistance and capable of securing the intensity of ultrasonic waves by applying electric anticorrosion treatment to the surfaces of an ultrasonic diaphragm. The present invention is completed based on this finding and the gist of the present invention is as follows:

(1) a method of ultrasonic pickling, characterized by impressing a protective potential of baser than the corrosion potential of an ultrasonic diaphragm installed in a pickling solution on the ultrasonic wave imposing means and carrying out pickling while supplying corrosion preventive current to a corrosion preventive current imposing means whose negative electric terminal is connected to the ultrasonic wave imposing means and whose positive electric terminal is connected to said pickling solution or a travelling strip material;.

(2) a method of ultrasonic pickling according to the item (1), characterized by impressing a protective potential of not less than −300 mV baser than the corrosion potential of an ultrasonic diaphragm on said ultrasonic wave imposing means and supplying corrosion preventive current of not less than 100 $mA/m^2$ to said ultrasonic diaphragm;

(3) an apparatus for ultrasonic pickling, characterized by having an ultrasonic wave imposing means installed in a pickling solution and a corrosion preventive current imposing means whose negative electric terminal is connected to said ultrasonic wave imposing means and whose positive electric terminal is connected to said pickling solution or a travelling strip material;

(4) an apparatus for ultrasonic pickling according to the item (3), characterized by hermetically sealing the circumference of a space formed by ultrasonic vibrators, the wiring for electric anticorrosion and an ultrasonic diaphragm with a box made of resin or metal.

BEST MODE FOR CARRYING OUT THE INVENTION

An explanation will be given hereunder based on the drawings as to the method of ultrasonic pickling and the pickling apparatus which take advantage of ultrasonic diaphragms to which electric anticorrosion treatment is applied according to the present invention.

Figure 1:
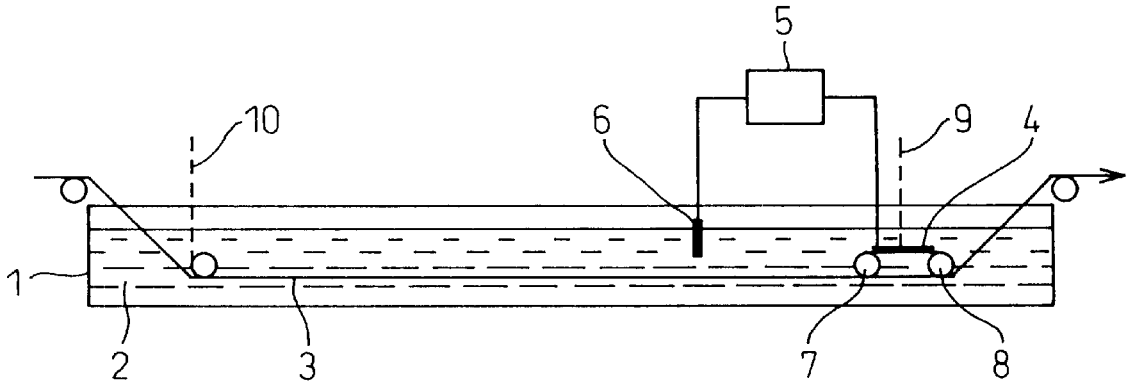
FIG. 1 is an illustration showing a pickling apparatus having an ultrasonic diaphragm to which electric anticorrosion treatment is applied according to the present invention.
Figure 2:
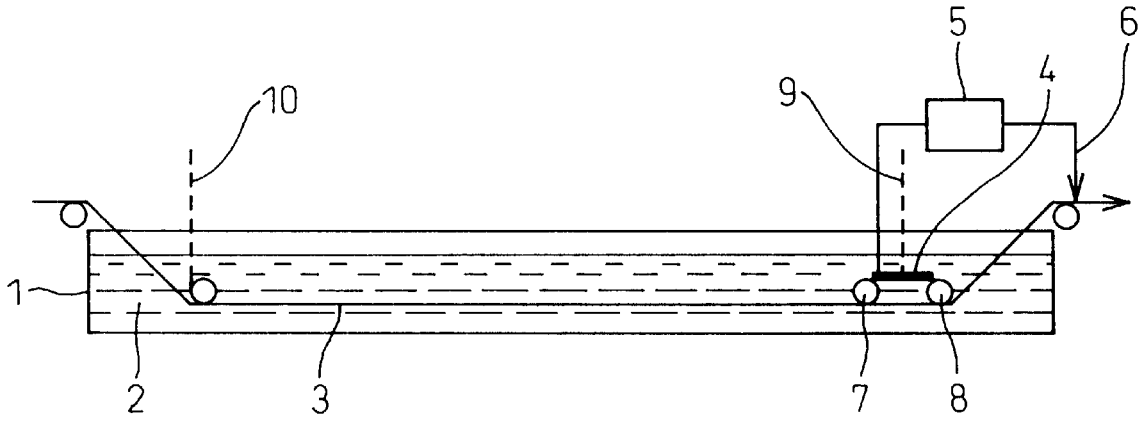
FIG. 2 is an illustration showing another embodiment of a pickling apparatus having an ultrasonic diaphragm to which electric anticorrosion treatment is applied according to the present invention.

FIGS. 1 and 2 are the illustrations showing ultrasonic diaphragms to which electric anticorrosion treatment is applied in a pickling apparatus according to the present invention. In FIG. 1, an ultrasonic diaphragm 4 is disposed so as to face a hot-rolled steel strip 3 in the full range of its width and support rolls 7 and 8 and a jig 9 are also disposed in an ultrasonic pickling tank 1 used for removing the scale on the hot-rolled steel strip 3 transferred into the pickling apparatus. Here, the travelling hot-rolled steel strip 3 is connected to the positive electric terminal of a power source 5 through an acid solution 2 and then an electrode 6 which is dipped in the acid solution 2, while the ultrasonic diaphragm 4 is connected to the negative electric terminal of the power source for anticorrosion 5. For a jig 9, a Teflon coated arm may be used, for example. The anodic corrosion reaction is suppressed by the corrosion protective current flowing from the positive electric terminal to the ultrasonic diaphragm 4, which is the negative electric terminal, and thus the acid resisting properties of the ultrasonic diaphragm 4 are improved. Further, as shown in FIG. 2, a similar effect can be obtained by connecting a hot-rolled steel strip 3 to the positive electric terminal of a power source 5 through an electrode 6 provided outside of the acid solution 2.

In the present invention, in order to suppress the anodic corrosion reaction, taken are the measures of impressing a protective potential of not less than −300 mV baser than the corrosion potential of an ultrasonic diaphragm 4 and supplying corrosion preventive current of not less than 100 $mA/m^2$ to the ultrasonic diaphragm 4. The effect of the present invention can be obtained even if the lower limit of the protective potential to be impressed on the ultrasonic diaphragm 4 is not particularly specified. However, it is preferable to impress a protective potential of not less than −1,000 mV baser than the corrosion potential of the ultrasonic diaphragm 4 for preventing the adhesion of smut. Further, the effect of the present invention can be achieved even if the upper limit of the corrosion preventive current per unit area is not particularly specified. However, it is preferable to supply a corrosion preventive current of not higher than 1,000 $mA/m^2$ to the ultrasonic diaphragm 4 for preventing adhesion of smut.

Figure 7:
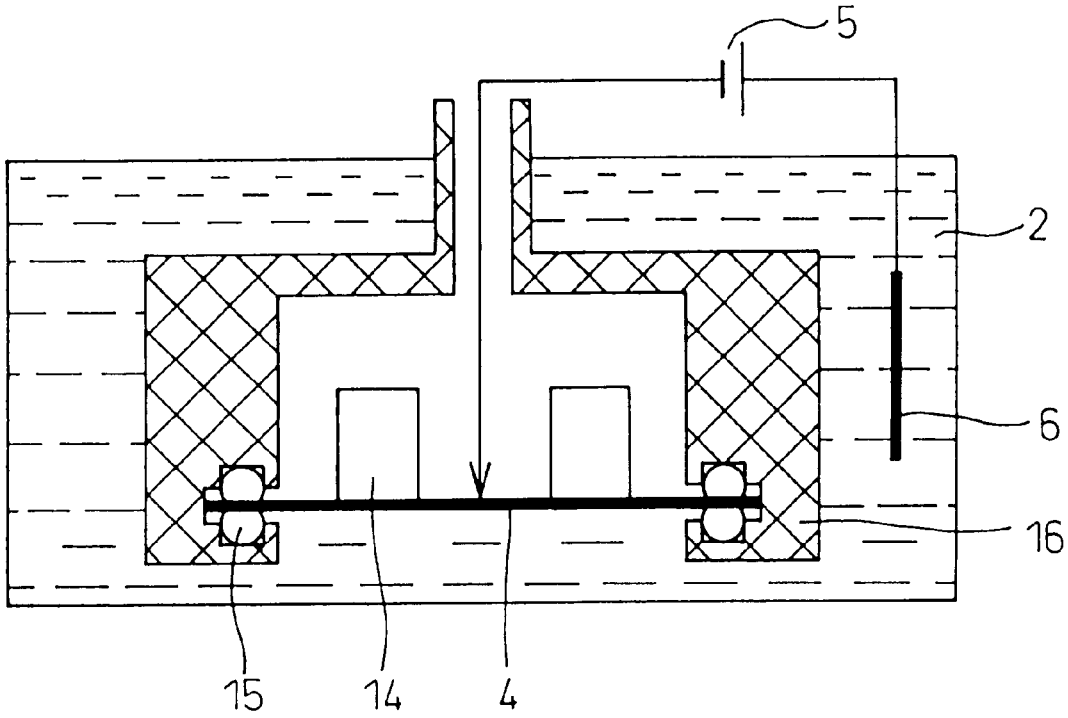
FIG. 7 is an illustration showing a pickling apparatus equipped with an ultrasonic diaphragm according to the present invention, wherein the circumference of a space formed by ultrasonic vibrators, the wiring for electric anticorrosion and an ultrasonic diaphragm is hermetically sealed with a box made of resin or metal.

Additionally, in the present invention, as shown in FIG. 7, it is preferable that a pickling apparatus be equipped with an ultrasonic diaphragm in which the circumference of a space formed by ultrasonic vibrators, the wiring for electric anticorrosion and the ultrasonic diaphragm is hermetically sealed with a box made of resin or metal. Since the circumference of a space formed by ultrasonic vibrators 14, the wiring for electric anticorrosion and an ultrasonic diaphragm 4 is hermetically sealed with a box 16 made of resin or metal, penetration of the acid solution into the aforementioned space can be prevented, and the life of the diaphragm can thus be further prolonged.

EXAMPLE

Examples of the present invention will be explained hereunder in detail referring to FIGS. 1 and 2.

In the longitudinal direction of a hot-rolled steel strip 3 to be descaled and in an ultrasonic pickling tank 1 with the size of 10 m in length, 2 m in width and 1 m in depth, an ultrasonic diaphragm 4 with the size of 1 m in length and 2 m in width was disposed so as to face said hot-rolled steel strip 3 in the full range of its width and support rolls 7 and 8 and a jig 9 were also disposed according to the present invention. A 5% hydrochloric acid solution was used as the acid solution 2, and iron was used as the material of the ultrasonic diaphragm 4. A Teflon coated arm was used as the jig 9. The travelling hot-rolled steel strip 3 was connected to the positive electric terminal of a power source 5 through the acid solution 2 and then the electrode 6 which was dipped in the acid solution 2, while the ultrasonic diaphragm 4 was connected to the negative electric terminal thereof. Carbon was used as the material of the electrode. A protective potential of −300 mV baser than the corrosion potential, −617 mV, of iron used as the ultrasonic diaphragm was impressed, and the corrosion preventive current of 200 mA was supplied. As a result, a sufficient corrosion preventive current was supplied to the ultrasonic diaphragm 4 securing 100 mA per one square meter of its area. FIG. 2 shows the case where a hot-rolled steel sheet 3 is connected to the positive electric terminal of a power source 5 through a brush provided outside of an acid solution 2 and used as an electrode 6. And sufficient corrosion preventive effect was obtained in this case too.

Figure 3:
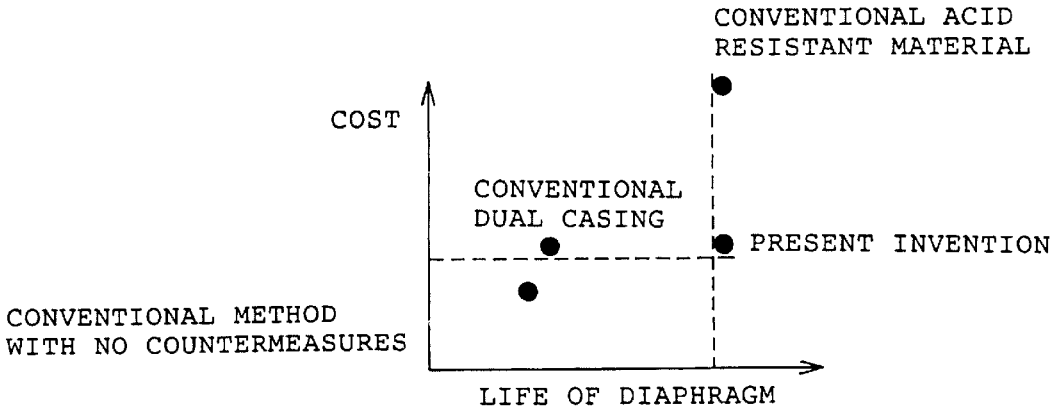
FIG. 3 is a graph showing the relationship between the cost of an ultrasonic diaphragm and the life prolonging effect according to the present invention.
Figure 4:
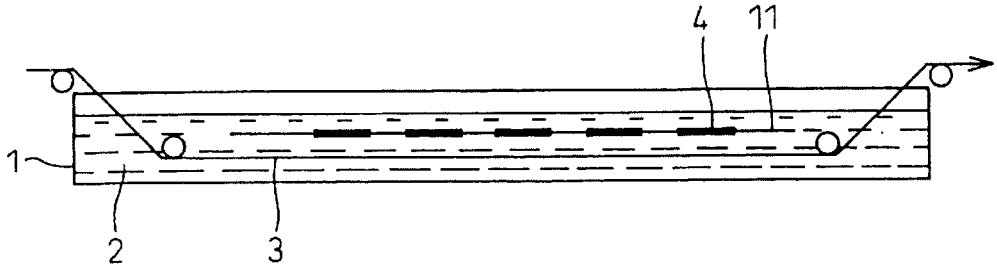
Fig.4 Prior Art
FIG. 4 is an illustration showing ultrasonic diaphragms installed in a conventional pickling apparatus.
Figure 5:
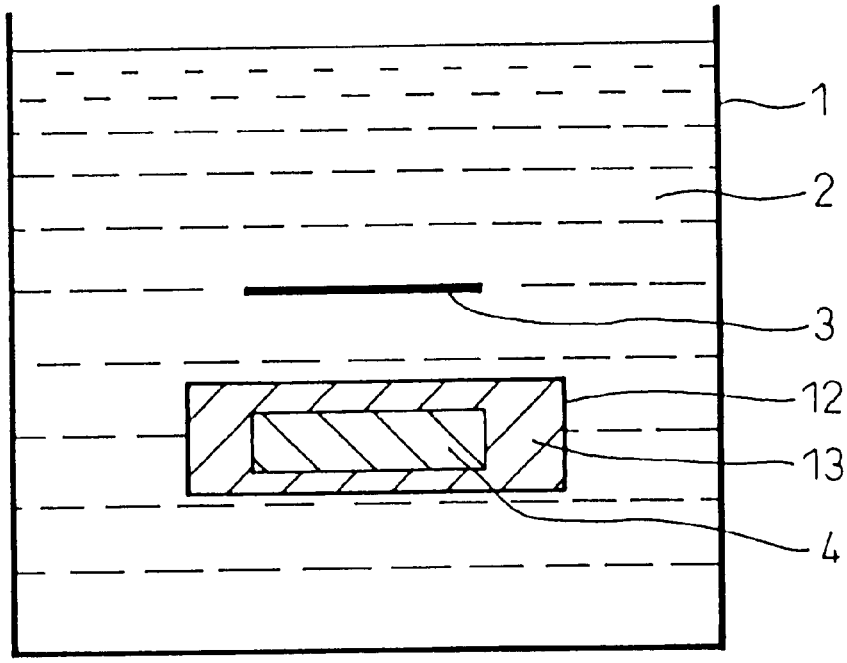
FIG. 5 is an illustration showing a pickling apparatus having an ultrasonic diaphragm mounted in a sealed protective casing of a conventional pickling apparatus.
Figure 6:
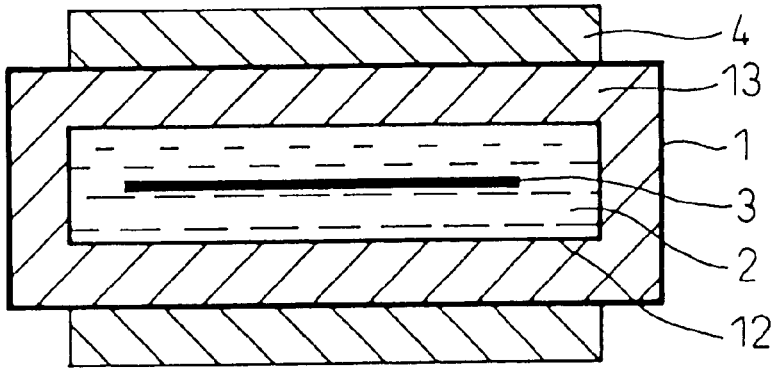
FIG. 6 is an illustration showing a pickling apparatus having ultrasonic diaphragms mounted on the exterior of a dual casing of a conventional pickling apparatus.

Additionally, as shown in FIG. 7, the circumference of a space formed by ultrasonic vibrators 14, the wiring for electric anticorrosion and an ultrasonic diaphragm 4 of 300 mm square was hermetically sealed with a box 16 made of resin or metal. Resin made O-rings 15 were used for sealing so as not to allow penetration of an acid solution into the inside of the ultrasonic diaphragm 4 through the junction of the ultrasonic diaphragm 4 and the resin made box 16. Suppression of cost increase of the ultrasonic vibrators has been made possible by reusing them after removing the ultrasonic diaphragm 14 from the resin made box 16 and replacing the ultrasonic diaphragm 4 with a new one. Shown in FIG. 3 is a relation between the cost of an ultrasonic diaphragm and its life prolonging effect in comparison with the cases of conventional methods. As is understood from FIG. 3, in the present invention, a life almost as long as the life of an acid resistant material in a conventional method could be maintained, and a cost almost as low as the cost of a dual casing type could be realized.

Further, also a big advantage is the applicability of the formation and the principle of an ultrasonic pickling method and a pickling apparatus therefor according to the present invention to the surface cleaning of various steel sheets and nonferrous metal sheets and the pretreatment of plating.

INDUSTRIAL APPLICABILITY

By adopting an ultrasonic pickling method and a pickling apparatus therefor according to the present invention, it has become possible: to achieve a pickling effect equal to or higher than the effects obtained in conventional methods by impressing a protective potential baser than the corrosion potential of an ultrasonic diaphragm and supplying a corrosion preventive current to the ultrasonic diaphragm; moreover to lower the pickling cost by simply adding the cost required for the electric anticorrosion treatment; and further to improve acid resisting properties of an ultrasonic diaphragm while maintaining the intensity of ultrasonic waves.

What is claimed is:

1. A method of ultrasonic pickling, characterized by impressing a protective potential of baser than the corrosion potential of an ultrasonic diaphragm installed in a pickling solution on the ultrasonic wave imposing means and carrying out pickling while supplying corrosion preventive current to a corrosion preventive current imposing means whose negative electric terminal is connected to the ultrasonic wave imposing means and whose positive electric terminal is connected to said pickling solution or a travelling strip material.

2. A method of ultrasonic pickling according to claim 1, characterized by impressing a protective potential of not less than −300 mV baser than the corrosion potential of an ultrasonic diaphragm on said ultrasonic wave imposing means and supplying corrosion preventive current of not less than 100 $mA/m^2$ to said ultrasonic diaphragm.

3. An apparatus for ultrasonic pickling, characterized by having an ultrasonic wave imposing means installed in a pickling solution and a corrosion preventive current imposing means whose negative electric terminal is connected to said ultrasonic wave imposing means and whose positive electric terminal is connected to said pickling solution or a travelling strip material.

4. An apparatus for ultrasonic pickling according to claim 3, characterized by hermetically sealing the circumference of a space formed by ultrasonic vibrators, the wiring for electric anticorrosion and an ultrasonic diaphragm with a box made of resin or metal.

* * * * *